US011852172B2

(12) United States Patent
O'Rorke et al.

(10) Patent No.: US 11,852,172 B2
(45) Date of Patent: Dec. 26, 2023

(54) SOLENOID DRIVEN ACTUATOR SYSTEMS

(71) Applicant: Hamilton Sundstrand Corporation, Charlotte, NC (US)

(72) Inventors: Morgan O'Rorke, West Hartford, CT (US); Steve Doerner, Enfield, CT (US); Ryan Susca, Windsor, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 0 days.

(21) Appl. No.: 17/675,551

(22) Filed: Feb. 18, 2022

(65) Prior Publication Data

US 2023/0265867 A1 Aug. 24, 2023

(51) Int. Cl.
*F15B 13/044* (2006.01)
*F15B 13/02* (2006.01)

(52) U.S. Cl.
CPC ..... *F15B 13/044* (2013.01); *F15B 13/02* (2013.01); *F15B 2211/405* (2013.01); *F15B 2211/426* (2013.01)

(58) Field of Classification Search
CPC ..... F15B 2211/8636; F15B 2211/862; F15B 2211/8623; F15B 2211/30565; F15B 13/0435; F15B 20/002
See application file for complete search history.

(56) References Cited

U.S. PATENT DOCUMENTS 4,637,587 A * 1/1987 Kuhnlein ..... G05B 9/03 251/30.01
4,783,107 A * 11/1988 Parker ..... B25J 15/0004 294/213
5,784,944 A * 7/1998 Tozawa ..... F15B 20/00 91/461
6,435,202 B2 * 8/2002 Zachary ..... G05B 9/03 251/30.01
6,722,383 B2 * 4/2004 Summers ..... G05B 9/03 700/282
6,755,214 B2 * 6/2004 Bento ..... F16K 31/426 137/625.64
9,382,953 B2 * 7/2016 Kuwahara ..... F16D 48/02
9,632,142 B2 4/2017 Day
9,689,505 B2 * 6/2017 Inagaki ..... F16K 31/42
10,502,590 B2 12/2019 Lillestolen et al.
10,577,080 B2 3/2020 Maver
10,704,411 B2 7/2020 Mielke
(Continued)

FOREIGN PATENT DOCUMENTS

DE 102019128921 A1 4/2020

OTHER PUBLICATIONS

Extended European Search Report for European Patnet Application No. EP23157118.3, dated Jun. 23, 2023.

*Primary Examiner* — Thomas E Lazo
(74) *Attorney, Agent, or Firm* — Locke Lord LLP; Alicia Carroll; Gabriella D'Angelo

(57) ABSTRACT

A solenoid driven actuator system includes a first solenoid having at least one pressure input and a pressure outlet downstream from the at least one pressure input. The system includes a second solenoid having at least one pressure input and a pressure outlet downstream from the at least one pressure input. The system includes a pressure-switching valve operatively coupled to the first and second solenoids. The system includes an actuator operatively coupled to the pressure outlet of the second solenoid.

15 Claims, 7 Drawing Sheets

(56) References Cited

U.S. PATENT DOCUMENTS

| | | | | |
|---|---|---|---|---|
| 10,988,126 | B2 * | 4/2021 | Roether | F16K 31/423 |
| 11,125,254 | B2 * | 9/2021 | Erikksson | F15B 11/10 |
| 11,204,045 | B2 * | 12/2021 | Martin-Meyer | B64C 13/40 |
| 11,215,067 | B2 * | 1/2022 | Delong | F01D 17/10 |
| 11,312,475 | B2 * | 4/2022 | Medina | B64C 9/323 |
| 11,415,154 | B2 * | 8/2022 | Greenwood | F15B 11/028 |
| 2019/0257328 | A1 * | 8/2019 | Erikksson | B62D 5/003 |
| 2020/0255126 | A1 * | 8/2020 | Medina | F15B 11/123 |
| 2020/0391846 | A1 * | 12/2020 | Medina | B64C 13/42 |
| 2021/0095699 | A1 | 4/2021 | Rudrapatna et al. | |

* cited by examiner

SOLENOID DRIVEN ACTUATOR SYSTEMS

BACKGROUND OF THE INVENTION

1. Field of the Invention

The present disclosure relates to actuator systems and more particularly to solenoid driven actuator systems.

2. Description of Related Art

In many turbine engines, effector actuation systems (vanes angle, nozzle area, etc) are usually modulated, but sometimes a two-position system may be advantageous. In modern turbine engines, weight and space are more critical than previous engines because of the increased externals content added to improve engine efficiency. A traditional modulating actuator system usually has two Electro-Hydraulic Servo Valves (EHSVs) and a solenoid driven transfer valve, which tend to be heavy.

The conventional techniques have been considered satisfactory for their intended purpose. However, there is a need for improved actuator systems. This disclosure provides a solution for this need.

SUMMARY OF THE INVENTION

A solenoid driven actuator system includes a first solenoid having at least one pressure input and a pressure outlet downstream from the at least one pressure input. The system includes a second solenoid having at least one pressure input and a pressure outlet downstream from the at least one pressure input. The system includes a pressure-switching valve operatively coupled to the first and second solenoids. The system includes an actuator operatively coupled to the pressure outlet of the second solenoid.

In accordance with some embodiments, the at least one pressure input of the first solenoid includes a first pressure input and a second pressure input. The at least one pressure input of the second solenoid can include a first pressure input and a second pressure input. The pressure-switching valve can be in fluid communication with the first pressure input of the second solenoid. The pressure outlet of the first solenoid can be in fluid communication with the second pressure input of the second solenoid.

The pressure-switching valve can include a first side, a second side and a slidable spool therebetween. The first side of the pressure-switching valve can be in fluid communication with a first pressure source through a first side pressure port. The second side of the pressure-switching valve can be in fluid communication with the pressure outlet of the first solenoid through a second side pressure port. The pressure-switching valve can include a secondary pressure port between the first and second sides of the pressure-switching valve. The secondary pressure port can be in fluid communication with a first pressure source. The pressure-switching valve can include an additional secondary pressure port between the first and second sides of the pressure-switching valve. The additional secondary pressure port can be in fluid communication with a second pressure source. At least one of the secondary pressure port or the additional secondary pressure port of the pressure-switching valve can be in fluid communication with a first pressure input of the second solenoid.

In accordance with another aspect, a method for controlling an actuator valve with a dual redundant solenoids includes providing a low pressure from a low pressure source to a first solenoid and providing a high pressure from a high pressure source to the first solenoid. The high pressure source is at a higher pressure relative to the low pressure source. The method includes providing the low pressure from the low pressure source to a pressure-switching valve. The method includes providing the high pressure from the high pressure source to the pressure-switching valve. The method includes providing a control pressure from at least one of the first solenoid or the pressure-switching valve to a second solenoid. The method includes controlling an actuator valve with an output of the second solenoid.

In some embodiments, the method includes controlling the actuator valve with the output of the second solenoid when the first solenoid is in a failure mode to the high pressure by providing the high pressure from the first solenoid to the pressure-switching valve thereby exposing a first inlet of the second solenoid to the low pressure source via the pressure-switching valve. The method can include controlling the actuator valve with the output of the second solenoid when the first solenoid is in a failure mode to the low pressure by providing the low pressure from the first solenoid to the pressure-switching valve thereby exposing a first inlet of the second solenoid to the high pressure source via the pressure-switching valve.

The method can include controlling the actuator valve with an output of the first solenoid when the second solenoid is in a failure mode by exposing a first side of the pressure-switching valve to the high pressure source thereby exposing a first inlet of the second solenoid to the low pressure source. The method can include controlling the actuator valve with an output of the first solenoid when the second solenoid is in a failure mode by exposing a first side of the pressure-switching valve to the low pressure source thereby exposing a first inlet of the second solenoid to the high pressure source.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
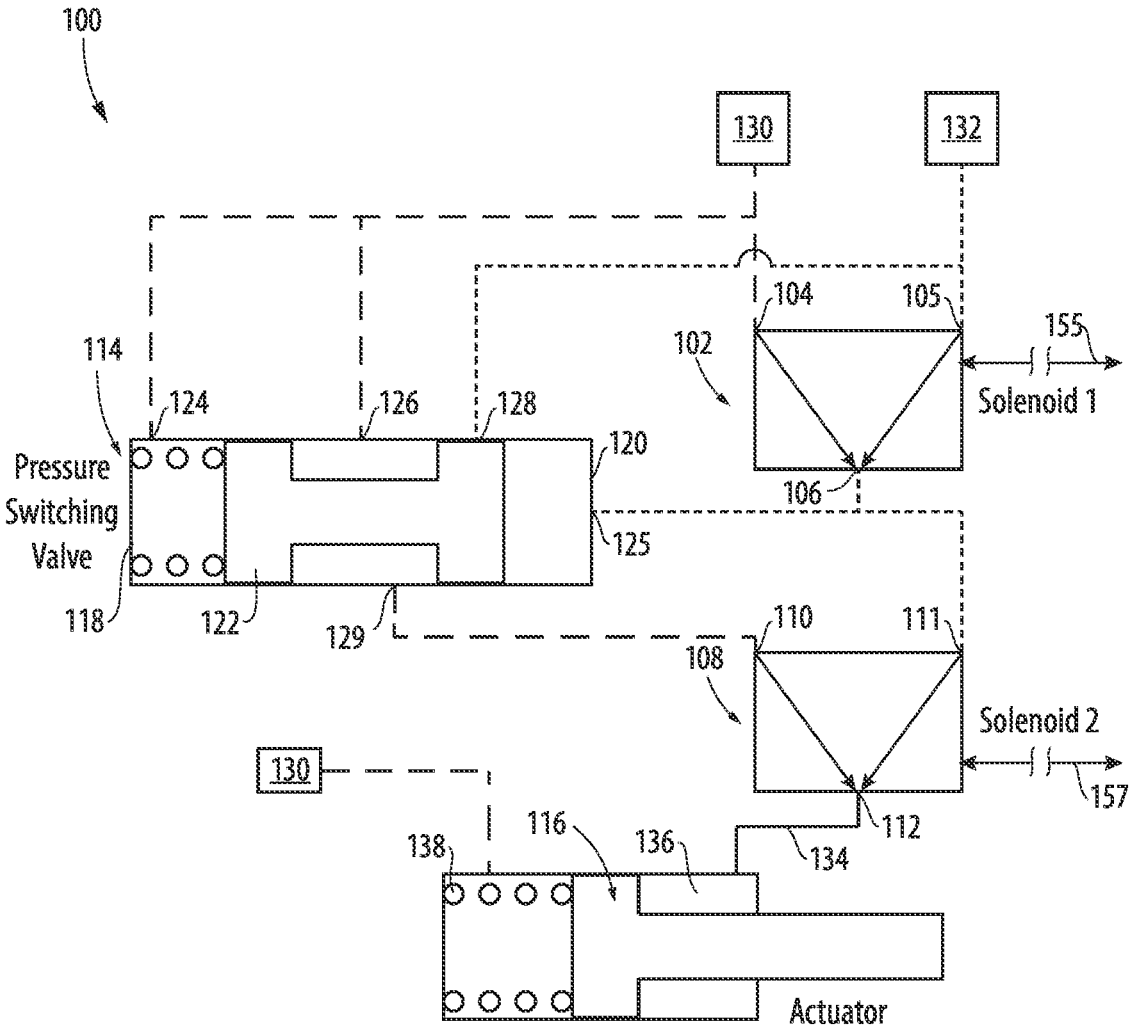
FIG. 1 is a schematic depiction of a solenoid driven actuator system constructed in accordance with an embodiment of the present disclosure, showing the first or second solenoid in control.

Reference will now be made to the drawings wherein like reference numerals identify similar structural features or aspects of the subject disclosure. For purposes of explanation and illustration, and not limitation, a schematic view of an exemplary embodiment of the solenoid driven actuator system in accordance with the disclosure is shown in FIG. 1 and is designated generally by reference character 100. Other embodiments of the solenoid driven actuator systems in accordance with the disclosure, or aspects thereof, are provided in FIGS. 2-7 as will be described. The systems and methods described herein can be used to provide a two-position actuator valve that is lighter weight and smaller in size than traditional modulating actuator systems.

As shown in FIG. 1, a solenoid driven actuator system 100 is a dual-redundant actuator system having two solenoids controlled on the same or different channels. System 100 includes a first solenoid 102 having a first pressure input 104 and a second pressure input 105 and a pressure outlet 106 downstream from pressure inputs 104 and 105. The system 100 includes a second solenoid 108 having a first pressure input 110, a second pressure input 111, and a pressure outlet 112 downstream from the pressure inputs 110 and 111. The system 100 includes a pressure-switching valve 114 operatively coupled to the first and second solenoids 102 and 108, respectively. The system 100 includes an actuator valve 116 operatively coupled to the pressure outlet 112 of the second solenoid 108. The first solenoid 102 controls the pressure going to the second solenoid 108 both directly and through the pressure switching valve 114. With a failure of either solenoid, control over actuator valve 116 can be maintained through the working solenoid.

With continued reference to FIG. 1, the pressure-switching valve 114 is in fluid communication with the first pressure input 110 of the second solenoid 108 via a pressure outlet 129. The pressure-switching valve 114 includes a first side 118, a second side 120 and a slidable spool 122 therebetween. The pressure outlet 106 of the first solenoid 102 is in fluid communication with the second pressure input 111 of the second solenoid 108. The first side 118 of the pressure-switching valve 114 is in fluid communication with a first pressure source 130 through a first side pressure port 124. The second side 120 of the pressure-switching valve 114 is in fluid communication with the pressure outlet 106 of the first solenoid 102 through a second side pressure port 125. The pressure-switching valve 114 includes a secondary pressure port 126 between the first and second sides 118 and 120, respectively, of the pressure-switching valve 114. The secondary pressure port 126 is in fluid communication with a first pressure source 130. The pressure-switching valve 114 includes an additional secondary pressure port 128 between the first and second sides, 118 and 120, respectively, of the pressure-switching valve 114. The additional secondary pressure port 128 is in fluid communication with a second pressure source 132. As described in more detail below, depending on the output from the first solenoid 102 at pressure outlet 106, either the secondary pressure port 126 or the additional secondary pressure port 128 of the pressure-switching valve 114 is in fluid communication with the first pressure input 110 of the second solenoid 108 via pressure outlet 129.

With continued reference to FIG. 1, system 100 is shown where both first and second solenoids 102 and 108, respectively, are both operational. In this state, either the first solenoid 102 or the second solenoid 108 can control the output to actuator valve 116. In accordance with some embodiments, control of first solenoid 102 is executed through a communication channel 155 and control of second solenoid 108 is executed with separate communication channel 157, e.g., one independent from communication channel 155. Those skilled in the art will readily appreciate that in accordance with some embodiments, first and second solenoids 102 and 108, respectively, can be controlled via a single communication channel. The channels, whether a single channel or two independent channels, can be operatively coupled to a FADEC (Full Authority Digital Engine Control). In FIG. 1, the second solenoid 108 is shown in control. Second solenoid 108 can supply an actuator control cavity 136 with a high pressure (e.g., from second pressure source 132) or a low pressure (e.g. from a first pressure source 130) via an actuator control line 134. Low-pressure is schematically shown with the larger dashed lines and high-pressure is schematically shown with the smaller dashed line throughout the figures. The pressure in actuator control cavity 136 controls whether spring 138 is compressed or released by controlling the axial position of an actuator body 140. In this state, it is also contemplated that the first solenoid 102 may also be used to control actuator valve 116 through the pressure-switching valve 114. Those skilled in the art will readily appreciate that in some embodiments, the actuator valve 116 may be arranged differently (e.g., spring 138 may positioned within the actuator control cavity 136) or may be a two-position valve.

Figure 2:
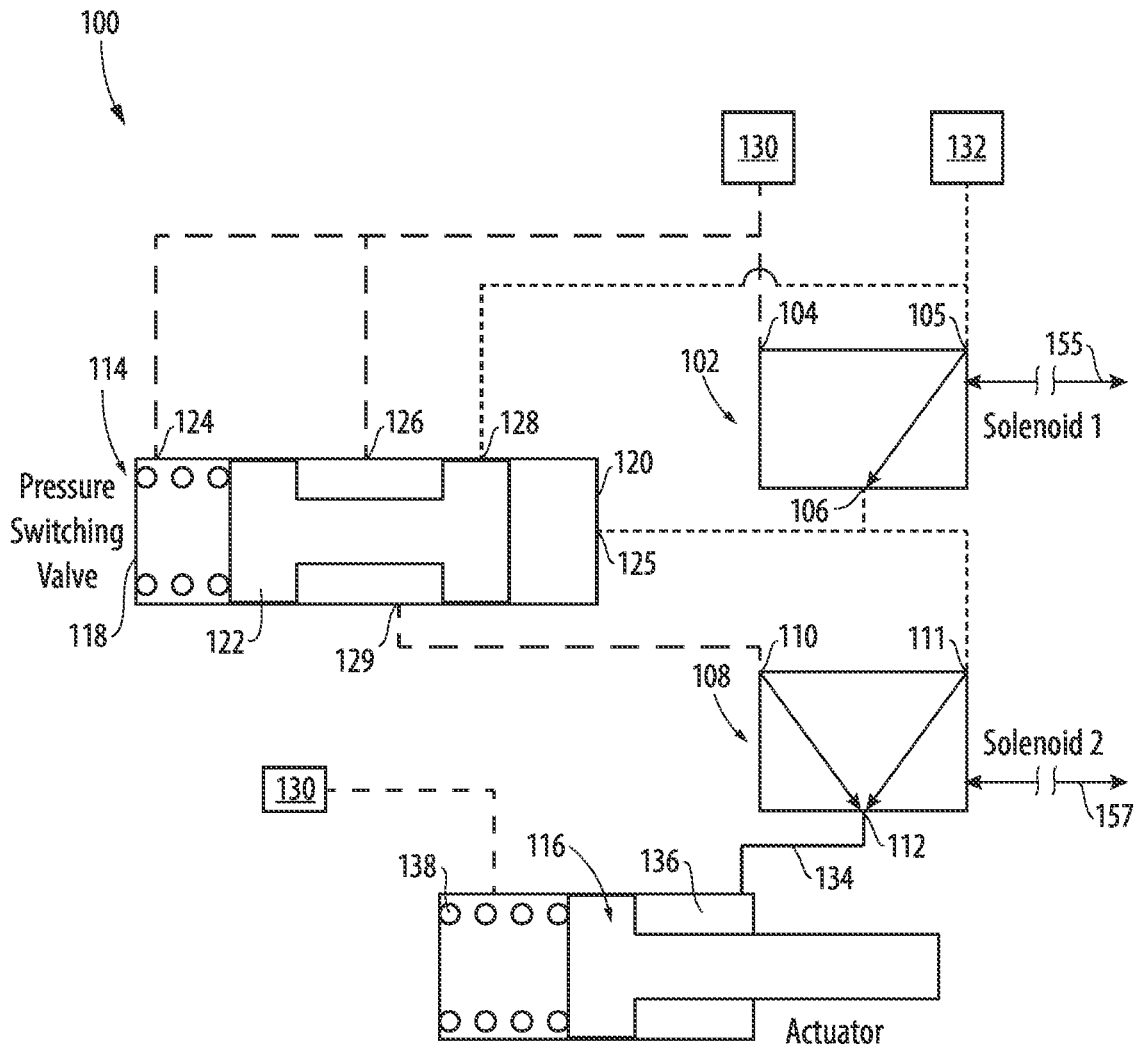
FIG. 2 is a schematic depiction of the system of FIG. 1, showing the second solenoid in control when the first solenoid has failed to high pressure.

With reference now to FIG. 2, the first solenoid 102 is in a failure condition where the first solenoid 102 has failed to high-pressure, e.g. the second pressure source 132. In this condition, the second solenoid 108 can be operated to direct the output at pressure output 112 to either high pressure via second pressure source 132 and first solenoid 102 or low pressure via first pressure source 130 and pressure switching valve 114. This ability stems from the opposite nature of the first solenoid 102 and the pressure-switching valve 114. When first solenoid 102 outputs a high pressure from pressure outlet 106, the spool 122 of pressure switching valve 114 moves left, opening the secondary pressure port 126 and thereby exposing the low pressure from first pressure source 130 to the first pressure input 110 of the second solenoid 108 via pressure outlet 129. The second pressure input 111 of the second solenoid 108 is supplied high pressure from second pressure source 132 via the failed first solenoid 102. As the second solenoid 108 is still functional, it is controlled to supply actuator control cavity 136 with either the high pressure or low pressure via actuator control line 134.

Figure 3:
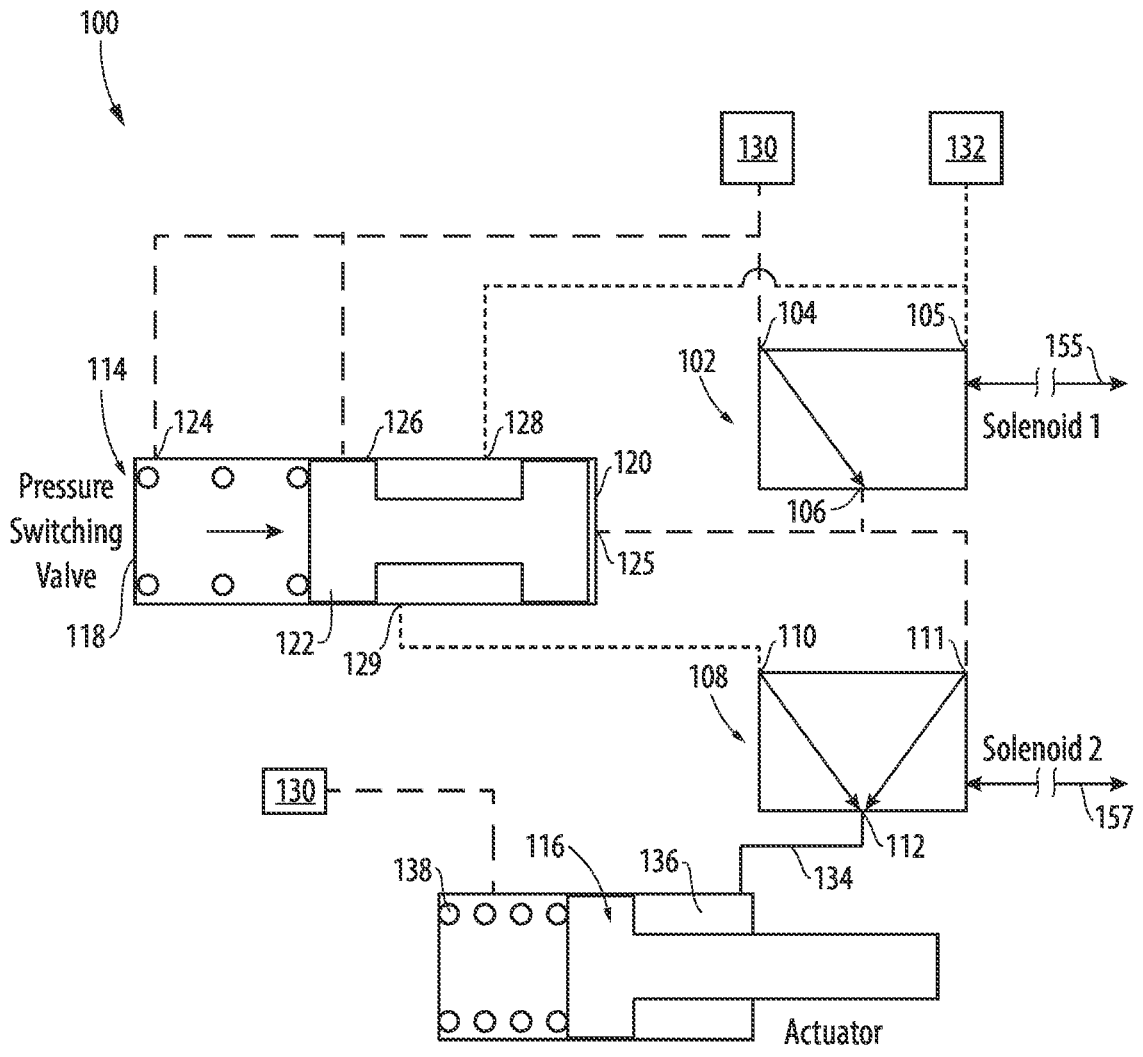
FIG. 3 is a schematic depiction of the system of FIG. 1, showing the second solenoid in control when the first solenoid has failed to low pressure.

As shown in FIG. 3, the second solenoid 108 is in control when the first solenoid 102 has failed to low pressure, e.g. the first power source 130. In this condition, the second solenoid 108 can be operated to direct the output at pressure output 112 to either low pressure via first pressure source 130 and first solenoid 102 or high pressure via second pressure source 132 and pressure switching valve 114. This ability stems from the opposite nature of the first solenoid 102 and the pressure-switching valve 114. When first solenoid 102 outputs a low pressure from pressure outlet 106, the spool 122 of pressure switching valve 114 moves right (e.g., relative to the position in FIG. 2), opening the additional secondary pressure port 128 and thereby exposing the high pressure from second pressure source 132 to the first pressure input 110 of the second solenoid 108 via pressure outlet 129. The second pressure input 111 of the second solenoid 108 is supplied low pressure from first pressure source 130 via the failed first solenoid 102. As the second solenoid 108 is still functional, it is controlled to supply actuator control cavity 136 with either the high pressure or low pressure via actuator control line 134.

Figure 4:
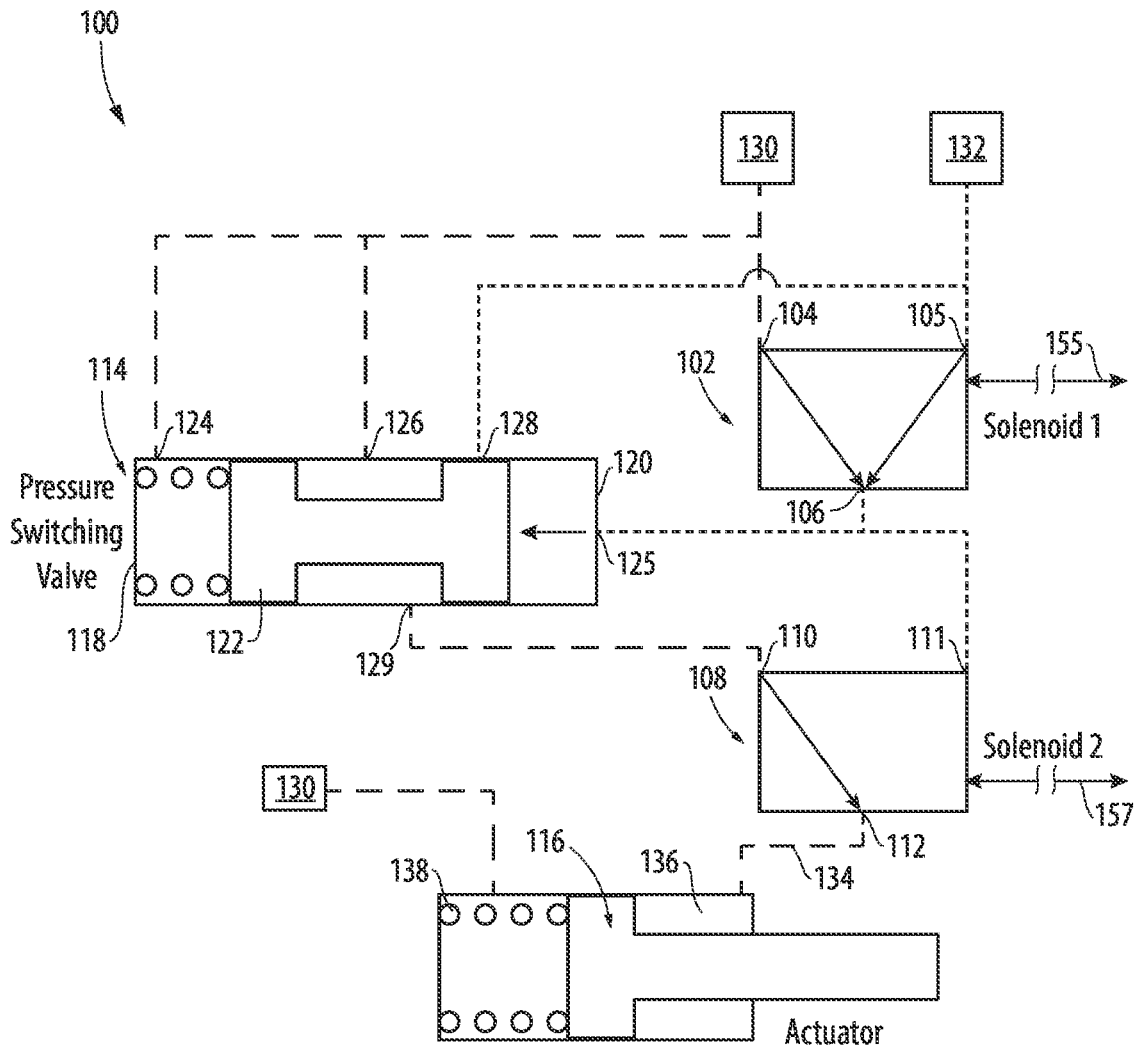
FIG. 4 is a schematic depiction of the system of FIG. 1, showing the first solenoid in control when a right side of the second solenoid has failed.
Figure 5:
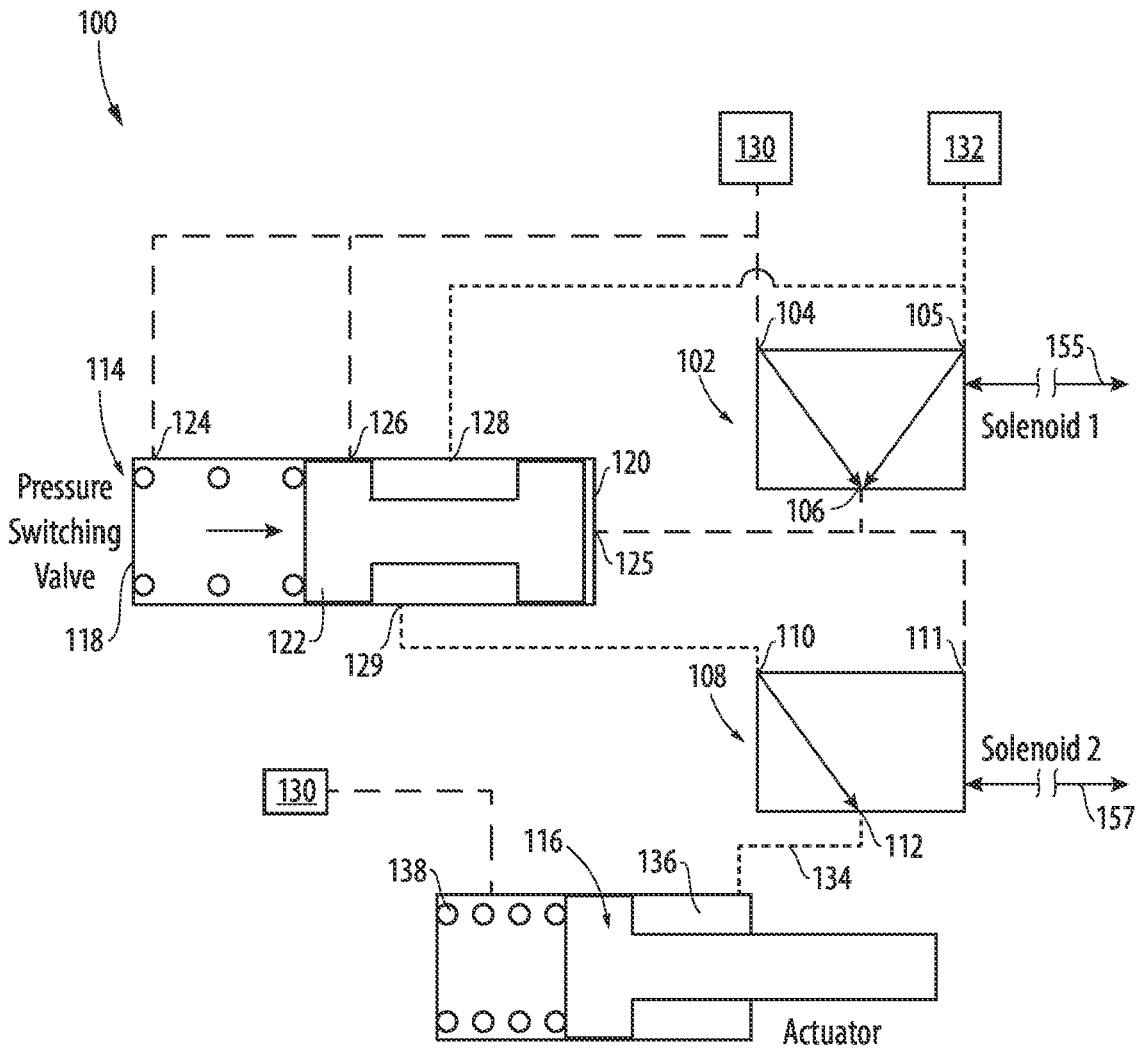
FIG. 5 is a schematic depiction of the system of FIG. 1, showing the first solenoid in control when a right side of the second solenoid has failed.

As shown in FIGS. 4-5, the first solenoid 102 is in control when the second solenoid 108 has failed such that second solenoid only passes fluid to the left input, e.g., first pressure input 110. In this condition, the first solenoid 102 can be operated to direct the output at pressure output 112 to either low pressure via first pressure source 130 and pressure switching valve 114 or high pressure via second pressure source 132 and pressure switching valve 114. This ability stems from the opposite nature of the first solenoid 102 and the pressure-switching valve 114. In FIG. 4, first solenoid 102 is shown outputting a high pressure from pressure outlet 106. The high pressure output from first solenoid 102 is received at side pressure port 125 and causes the spool 122 of pressure switching valve 114 moves left away from second side 120 of pressure switching valve 114. This translation of the spool 122 causes the secondary pressure port 126 to open and thereby exposes the low pressure first pressure source 130 to the first pressure input 110 of the second solenoid 108 via pressure outlet 129. The second solenoid 108 then provides the low-pressure to the actuator control line 134 via a pressure outlet 112. In FIG. 5, first solenoid 102 is shown outputting a low pressure from pressure outlet 106. The low pressure output from first solenoid 102 is received at side pressure port 125 and causes the spool 122 of pressure switching valve 114 to move right toward the second side 120 of pressure switching valve 114. This translation of the spool 122 causes the additional secondary pressure port 128 to open and thereby exposes the high pressure second pressure source 132 to the first pressure input 110 of the second solenoid 108 via the pressure outlet 129. The second solenoid 108 then provides the high-pressure to the actuator control line 134 via a pressure outlet 112.

Figure 6:
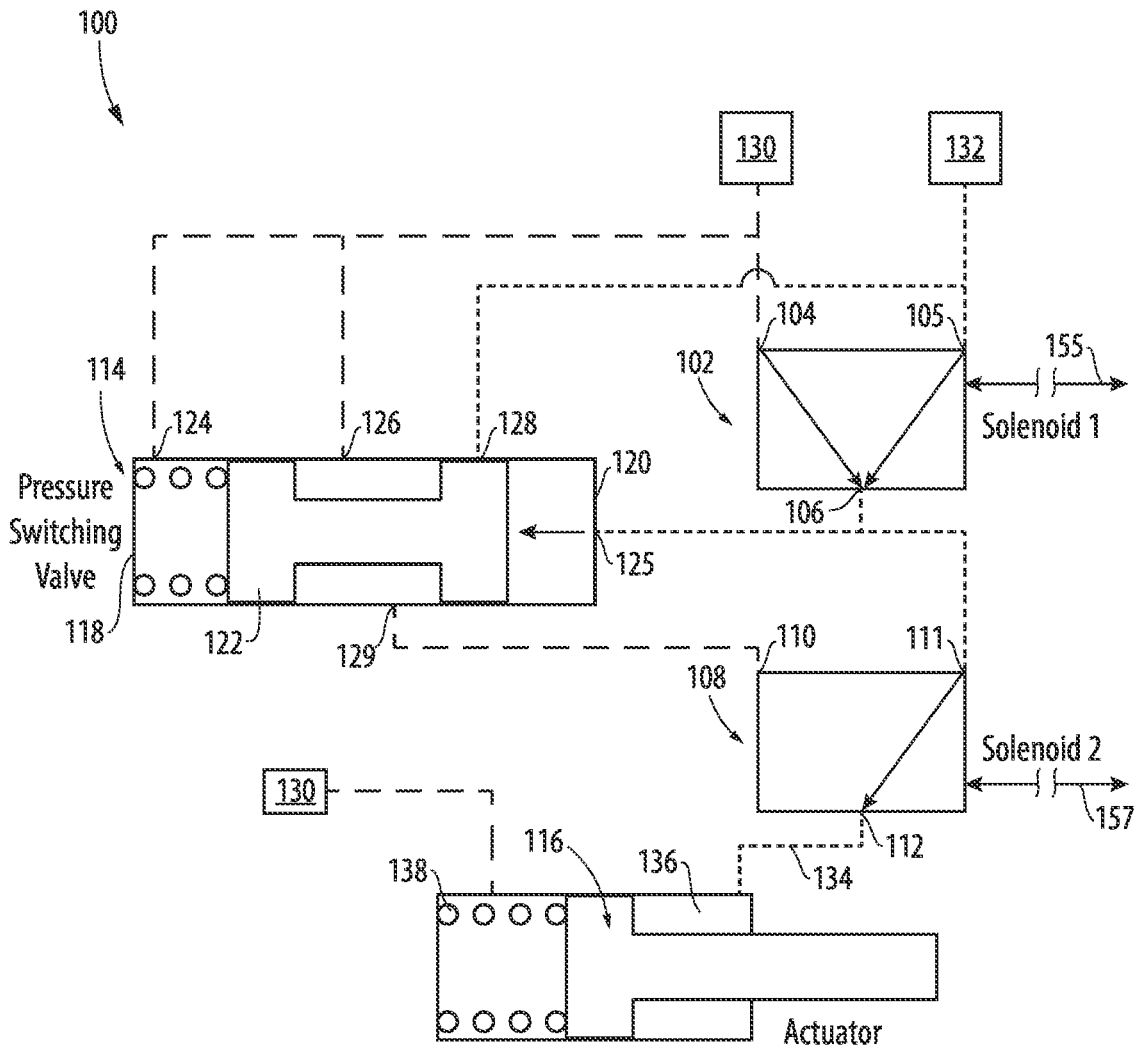
FIG. 6 is a schematic depiction of the system of FIG. 1, showing the first solenoid in control when a left side of the second solenoid has failed.
Figure 7:
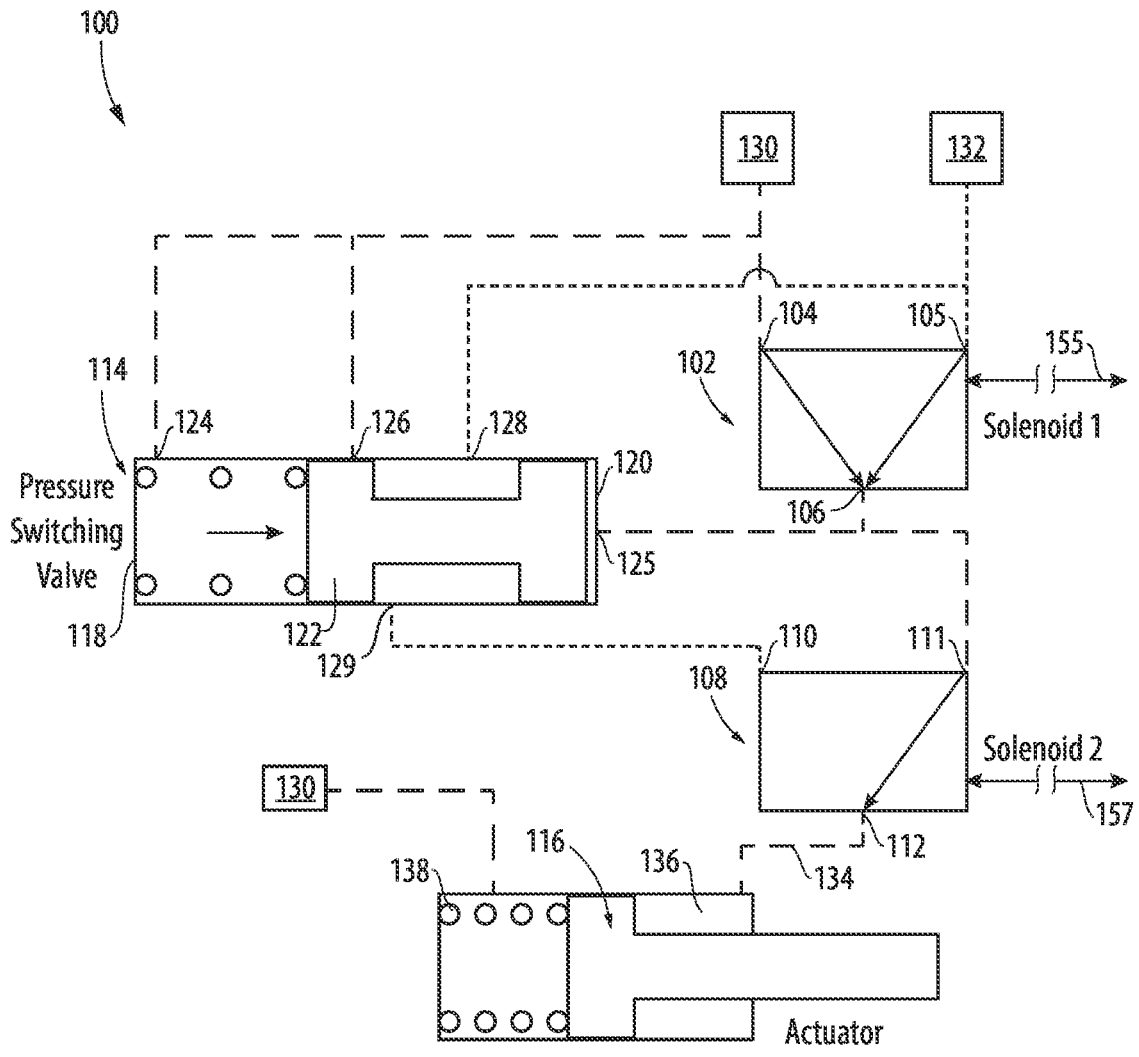
FIG. 7 is a schematic depiction of the system of FIG. 1, showing the first solenoid in control when a left side of the second solenoid has failed.

As shown in FIGS. 6-7, the first solenoid 102 is in control when the second solenoid 108 has failed such that second solenoid 108 only passes fluid to the right input, e.g., second pressure input 111. In this condition, the first solenoid 102 can be operated to direct the output at pressure output 112 to either low pressure via first pressure source 130 or high pressure via second pressure source 132. In this condition, the pressure-switching valve 114 does not affect any control of the second solenoid 102. In FIG. 6, first solenoid 102 is shown outputting a high pressure from pressure outlet 106 to the second pressure input 111 of the second solenoid 108. The second solenoid 108 then provides the high-pressure to the actuator control line 134 via a pressure outlet 112. In FIG. 7, first solenoid 102 is shown outputting a low pressure from pressure outlet 106. The low-pressure output from first solenoid 102 is received at the second pressure input 111 of the second solenoid 108. The second solenoid 108 then provides the low-pressure to the actuator control line 134 via a pressure outlet 112

As solenoids 102 and 108 are smaller and lighter than EHSVs, system 100 provides reduced weight and reduced size envelope as compared with traditional EHSVs. Moreover, if the effector system that the actuator body 140 controls does not have its own means of tracking performance (e.g., via position sensor, pressure sensor, temperature sensor, etc.) embodiments of system 100 can use proximity probes (which have good resolution to determine position in a non-modulated actuator) to determine the left or right position of the actuator body 140. Proximity probes are magnetic sensors that can be installed in the actuator valve 116 to determine position of actuator body 140 (e.g., is the actuator body in the left or right position). Proximity probes are lighter than a linear variable differential transformer (LVDT), which would typically be used to detect the position of the actuator in an EHSV system. The ability to use these proximity probes results in further potential weight and size reduction as compared with traditional EHSV systems. Additionally, because solenoids 102 and 108 have little to no internal leakage, system 100 also provides for improved fuel system efficiency and reliability as compared with EHSVs. The simplified control nature of solenoids, e.g., the simple I/O control structure, provides easier control as compared with EHSVs. As such, in situations where a non-modulated effector is appropriate, system 100 offers considerable benefits over traditional EHSVs.

A method for controlling an actuator, e.g. actuator valve 116, with dual redundant solenoids, e.g. first and second solenoids 102 and 108, includes providing a low pressure from a low pressure source, e.g. first pressure source 130, to the first solenoid and providing a high pressure from a high pressure source, e.g. second pressure source 132 to the first solenoid. The method includes providing the low pressure from the low-pressure source to a pressure-switching valve, e.g. pressure switching valve 114. The method includes providing the high pressure from the high-pressure source to the pressure-switching valve. In FIG. 1, where both the first and second solenoids 102 and 108 are operational, the method includes providing a control pressure from either the first solenoid or the second solenoid. The method includes controlling an actuator valve, e.g., actuator valve 116, with an output of the second solenoid.

When the first solenoid is in a failure mode to the high-pressure source, e.g., as shown in FIG. 2, the method includes controlling the actuator valve with the output of the second solenoid by providing the high pressure from the first solenoid to a second pressure input, e.g., the second pressure input 111, of the second solenoid and to the pressure-switching valve thereby exposing a first inlet, e.g. a first inlet 110, of the second solenoid to the low pressure source via a pressure outlet, e.g. pressure outlet 129, of the pressure-switching valve. As the second solenoid is still functional, the method includes controlling the second solenoid to supply an actuator control cavity, e.g. actuator control cavity 136, with either the high pressure or low pressure via an actuator control line, e.g., the actuator control line 134.

When the first solenoid is in a failure mode to the low pressure source, e.g., as shown in FIG. 3, the method includes controlling the actuator valve with the output of the second solenoid by providing the low pressure from the first solenoid to the second pressure input of the second solenoid and to the pressure-switching valve thereby exposing a first inlet, e.g. a first inlet 110, of the second solenoid to the high pressure source via the pressure outlet of the pressure-switching valve. As the second solenoid is still functional, the method includes controlling the second solenoid to supply the actuator control cavity with either the high pressure or low pressure via the actuator control line.

When the second solenoid is in a failure mode to its left side, as shown in FIGS. 4-5, the method includes controlling the actuator valve with an output of the first solenoid. As shown in FIG. 4, if a high-pressure output at the pressure outlet is desired, the method includes exposing the first side of the pressure-switching valve to the low-pressure source. The low-pressure source provided to the pressure switching valve acts to expose the first inlet of the second solenoid to the high-pressure source via the pressure outlet of the pressure-switching valve and provides a high-pressure source to the actuator control line via a pressure outlet, e.g. pressure outlet 112, of the second solenoid. As shown in FIG. 5, if a low-pressure output at the pressure outlet is desired, the method includes controlling the actuator valve with an output of the first solenoid by exposing the first side of the pressure-switching valve to the high-pressure source. The high-pressure source provided to the pressure-switching valve acts to expose the first inlet of the second solenoid to the low-pressure source via the pressure outlet of the pressure-switching valve, thereby providing a low-pressure source to the actuator control line via the pressure outlet of the second solenoid.

When the second solenoid is in a failure mode to its right side, as shown in FIGS. 6-7, the method includes controlling the actuator valve with an output of the first solenoid by exposing a second inlet, e.g. a second inlet 111, of the second solenoid to either the high pressure source or low pressure source. As shown in FIG. 6, if a high-pressure output at the pressure outlet is desired, the method includes controlling the actuator valve with an output of the first solenoid by exposing the second inlet of the second solenoid to the low pressure source and thereby providing a low pressure source to the actuator control line via a pressure outlet of the second solenoid. As shown in FIG. 7, if a low pressure output at the pressure outlet of the second solenoid is desired, the method includes controlling the actuator valve with an output of the first solenoid by exposing a second inlet of the second solenoid to the low pressure source and thereby providing a low pressure source to the actuator control line via a pressure outlet of the second solenoid.

The methods and systems of the present disclosure, as described above and shown in the drawings, provide for solenoid driven actuator system, with superior properties including reduced weight and size, and increased reliability and efficiency. The systems and methods of the present invention can apply to a variety of actuators, or the like. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A solenoid driven actuator system, the system comprising:

a first solenoid having at least one pressure input and a pressure outlet downstream from the at least one pressure input;

a second solenoid having at least one pressure input and a pressure outlet downstream from the at least one pressure input;

a pressure-switching valve operatively coupled to the first and second solenoids; and an actuator valve operatively coupled to the pressure outlet of the second solenoid, wherein the pressure-switching valve includes a first side, a second side and a slidable spool therebetween; and wherein the first side of the pressure-switching valve is in fluid communication with a first pressure source through a first side pressure port.

2. The solenoid driven actuator system of claim 1, wherein the at least one pressure input of the first solenoid includes a first pressure input and a second pressure input.

3. The solenoid driven actuator system of claim 1, wherein the at least one pressure input of the second solenoid includes a first pressure input and a second pressure input.

4. The solenoid driven actuator system of claim 3, wherein the pressure-switching valve is in fluid communication with the first pressure input of the second solenoid.

5. The solenoid driven actuator system of claim 3, wherein the pressure outlet of the first solenoid is in fluid communication with the second pressure input of the second solenoid.

6. The solenoid driven actuator system of claim 1, wherein the second side of the pressure-switching valve is in fluid communication with the pressure outlet of the first solenoid through a second side pressure port.

7. The solenoid driven actuator system of claim 1, wherein the pressure-switching valve includes a secondary pressure port between the first and second sides of the pressure-switching valve, wherein the secondary pressure port is in fluid communication with a first pressure source.

8. The solenoid driven actuator system of claim 7, wherein the pressure-switching valve includes an additional secondary pressure port between the first and second sides of the pressure-switching valve, wherein the additional secondary pressure port is in fluid communication with a second pressure source.

9. The solenoid driven actuator system of claim 8, wherein at least one of the secondary pressure port or the additional secondary pressure port of the pressure-switching valve is in fluid communication with a first pressure input of the second solenoid.

10. A method for controlling an actuator valve with dual redundant solenoids, the method comprising:

providing a low pressure from a low pressure source to a first solenoid;

providing a high pressure from a high pressure source to the first solenoid, wherein the high pressure source is at a higher pressure relative to the low pressure source;

providing the low pressure from the low pressure source to a pressure-switching valve;

providing the high pressure from the high pressure source to the pressure-switching valve;

providing a control pressure from at least one of the first solenoid or the pressure-switching valve to a second solenoid;

controlling an actuator valve with an output of the second solenoid when the first solenoid is in a failure mode to at least one of the high pressure or the low pressure by providing at least one of the high pressure or the low pressure from the first solenoid to the pressure-switching valve.

11. The method as recited in claim 10, wherein controlling the actuator valve with the output of the second solenoid includes controlling the actuator valve with the output of the second solenoid when the first solenoid is in the failure mode to the high pressure by providing the high pressure from the first solenoid to the pressure-switching valve thereby exposing a first inlet of the second solenoid to the low pressure source via the pressure-switching valve.

12. The method as recited in claim 10, wherein controlling the actuator valve with the output of the second solenoid includes controlling the actuator valve with the output of the second solenoid when the first solenoid is in the failure mode to the low pressure by providing the low pressure from the first solenoid to the pressure-switching valve thereby exposing a first inlet of the second solenoid to the high pressure source via the pressure-switching valve.

13. A method for controlling an actuator valve with a dual redundant solenoids, the method comprising:

providing a low pressure from a low pressure source to a first solenoid;

providing a high pressure from a high pressure source to the first solenoid, wherein the high pressure source is at a higher pressure relative to the low pressure source;

providing the low pressure from the low pressure source to a pressure-switching valve;

providing the high pressure from the high pressure source to the pressure-switching valve;

providing a control pressure from at least one of the first solenoid or the pressure-switching valve to a second solenoid;

controlling an actuator valve with an output of the second solenoid; and controlling the actuator valve with an output of the first solenoid when the second solenoid is in a failure mode by exposing a first side of the pressure-switching valve to at least one of the low pressure source or the high pressure source.

14. The method as recited in claim 13, wherein controlling the actuator valve with an output of the first solenoid when the second solenoid is in the failure mode includes exposing the first side of the pressure-switching valve to the high pressure source thereby exposing a first inlet of the second solenoid to the low pressure source.

15. The method as recited in claim 13, wherein controlling the actuator valve with an output of the first solenoid when the second solenoid is in the failure mode includes exposing the first side of the pressure-switching valve to the low pressure source thereby exposing a first inlet of the second solenoid to the high pressure source.

* * * * *